US008306465B2

(12) United States Patent
Yoon et al.

(10) Patent No.: US 8,306,465 B2
(45) Date of Patent: Nov. 6, 2012

(54) IMAGE FORMING APPARATUS HAVING VARYING DISTANCES BETWEEN PHOTOSENSITIVE DRUMS AND TRANSFER ROLLERS

(75) Inventors: Jang-hee Yoon, Suwon-si (KR); Jeong-hwan Kim, Gunsan-si (KR); Se-ra Lee, Suwon-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 247 days.

(21) Appl. No.: 12/725,695

(22) Filed: Mar. 17, 2010

(65) Prior Publication Data

US 2011/0085826 A1 Apr. 14, 2011

(30) Foreign Application Priority Data

Oct. 9, 2009 (KR) ..... 10-2009-0096248

(51) Int. Cl.
*G03G 15/01* (2006.01)

(52) U.S. Cl. ..... 399/299; 399/300

(58) Field of Classification Search ..... 399/299, 399/300

See application file for complete search history.

(56) References Cited

U.S. PATENT DOCUMENTS

| | | | | |
|---|---|---|---|---|
| 4,931,839 | A | 6/1990 | Tompkins et al. | |
| 5,119,139 | A | 6/1992 | Torisawa | |
| 5,469,248 | A * | 11/1995 | Fujiwara et al. | 399/314 |
| 6,850,726 | B1 | 2/2005 | Mizuno et al. | |
| 2001/0031160 | A1 * | 10/2001 | Tanaka | 399/298 |
| 2004/0136758 | A1 * | 7/2004 | Kera et al. | 399/299 |
| 2005/0063739 | A1 * | 3/2005 | Kobayashi et al. | 399/299 |
| 2007/0059050 | A1 * | 3/2007 | Ishida | 399/298 |
| 2007/0183816 | A1 * | 8/2007 | Hatayama et al. | 399/299 |
| 2011/0064466 | A1 * | 3/2011 | Inada | 399/121 |

FOREIGN PATENT DOCUMENTS

| | | | |
|---|---|---|---|
| JP | 2908344 | | 6/1999 |
| JP | 2003-098800 | | 4/2003 |
| JP | 2007108788 | A * | 4/2007 |
| JP | 2008107506 | A * | 5/2008 |

* cited by examiner

*Primary Examiner* — David Gray
*Assistant Examiner* — G. M. Hyder
(74) *Attorney, Agent, or Firm* — Stanzione & Kim, LLP

(57) ABSTRACT

An image forming apparatus includes a plurality of optical scanning units to scan light modulated according to an image signal, a plurality of photoconductive drums to form a plurality of electrostatic latent images by the light scanned from the plurality of optical scanning units, a plurality of developing units to develop the plurality of electrostatic latent images formed on the plurality of photoconductive drums into a plurality of toner images, an intermediate transfer unit to transfer the plurality of toner images developed by the plurality of developing units, a plurality of first transfer rollers installed in the intermediate transfer unit to correspond to the plurality of photoconductive drums, respectively, and to apply transfer voltages that is used to transfer the plurality of toner images onto the intermediate transfer unit, a second transfer roller to transfer the plurality of toner images formed on the intermediate transfer unit onto a paper, and a fixing unit to fix the plurality of toner images transferred onto the paper, wherein the plurality of first transfer rollers includes the first transfer rollers of a first group in which distances between the first transfer rollers of the first group and the plurality of photoconductive drums, respectively, are sequentially reduced downstream along a direction that the intermediate transfer unit travels, and the first transfer roller of a second group is independent from the distances between the first transfer rollers of the first group and the plurality of photoconductive drums.

11 Claims, 5 Drawing Sheets

IMAGE FORMING APPARATUS HAVING VARYING DISTANCES BETWEEN PHOTOSENSITIVE DRUMS AND TRANSFER ROLLERS

CROSS-REFERENCE TO RELATED APPLICATIONS

This application claims priority under 35 U.S.C. §119 from Korean Patent Application No. 10-2009-0096248, filed on Oct. 9, 2009, in the Korean Intellectual Property Office, the disclosure of which is incorporated herein in its entirety by reference.

BACKGROUND

1. Field of the Invention

The present general inventive concept relates to an indirect transfer type image forming apparatus.

2. Description of the Related Art

Electrophotographic image forming apparatuses print an image by scanning an optical beam using an optical scanning unit, forming an electrostatic latent image on a photoconductive drum, developing the electrostatic latent image using toner, transferring the developed image onto a printing medium, and fixing the transferred image on the printing medium.

There are two types of electrophotographic image forming apparatuses: ones that directly transfer an image developed on a photoconductor onto a sheet of paper and fix the transferred image thereon, and ones that transfer an image developed on a photoconductor onto an intermediate transfer unit, overlap the transferred image with another image, transfer the overlapping image onto a sheet of paper, and fix the transferred image thereon.

The latter electrophotographic image forming apparatuses are classified as direct transfer type electrophotographic image forming apparatuses and indirect transfer type electrophotographic image forming apparatuses. When an image developed on a photoconductor is transferred onto an intermediate transfer unit, the former apparatuses simultaneously perform a pressure transfer and a magnetic field transfer since the photoconductor and a transfer roller are pressed against each other. The latter apparatuses perform the magnetic field transfer when the developed image is transferred onto the intermediate transfer unit since the photoconductor and the transfer roller are spaced apart from each other.

The indirect transfer type electrophotographic image forming apparatuses sequentially transfer color images onto the intermediate transfer unit, which increases a toner layer. Thus, it is necessary to sequentially increase voltages applied to a transfer roller for efficient transfer control.

SUMMARY

The present general inventive concept provides an image forming apparatus that efficiently controls a toner transfer from a photoconductor onto an intermediate transfer unit so as to form a color image.

Additional aspects and utilities of the present general inventive concept will be set forth in part in the description which follows and, in part, will be obvious from the description, or may be learned by practice of the general inventive concept.

According to features and utilities of the present general inventive concept, there is provided an image forming apparatus including a plurality of optical scanning units to scan light modulated according to an image signal, a plurality of photoconductive drums to form a plurality of electrostatic latent images by the light scanned from the plurality of optical scanning units, a plurality of developing units to develop the plurality of electrostatic latent images formed on the plurality of photoconductive drums into a plurality of toner images, an intermediate transfer unit to transfer the plurality of toner images developed by the plurality of developing units, a plurality of first transfer rollers installed in the intermediate transfer unit to correspond to the plurality of photoconductive drums, respectively, and to apply transfer voltages used to transfer the plurality of toner images onto the intermediate transfer unit, a second transfer roller to transfer the plurality of toner images formed on the intermediate transfer unit onto a paper, and a fixing unit to fix the plurality of toner images transferred onto the paper, wherein the plurality of first transfer rollers including the first transfer rollers of a first group in which distances between the first transfer rollers of the first group and the plurality of photoconductive drums, respectively, are sequentially reduced downstream along a direction that the intermediate transfer unit travels, and the first transfer roller of a second group is independent from the distances between the first transfer rollers of the first group and the plurality of photoconductive drums.

According to features and utilities of the present general inventive concept, there is provided an image transfer apparatus usable with an image forming apparatus to form an image, including a transfer unit to move in a direction, a plurality of photoconductive drums formed with corresponding toner images, and a plurality of rollers spaced apart from each other and disposed to form corresponding transfer voltages with the corresponding photoconductive drums to transfer the respective toner images of the photoconductive drums to the transfer unit as the image, wherein at least one of the rollers is spaced apart from a corresponding one of the photoconductive drums by a distance, and another one of the rollers is spaced apart from the corresponding one of the photoconductive drums by another distance which is different from the distance.

According to features and utilities of the present general inventive concept, there is provided an image transfer apparatus usable with an image forming apparatus to form an image, including a transfer unit to move in a direction, a first pair of a photoconductive drum and a roller which are spaced apart from each other by a first distance to transfer a first toner image to the transfer unit, and a second pair of a photoconductor drum and a roller which are spaced apart from each other by a second distance to transfer a second toner image to the transfer unit, wherein the first distance may be different from the second distance.

The image transfer apparatus may further include another pair of a photoconductive drum and a roller which are separated from each other by another distance to transfer another toner image to the transfer unit. The another distance may be same as at least one of the first distance and the second distance.

The image transfer apparatus may further include a third pair of a photoconductive drum and a roller which are separated from each other by a third distance to transfer a third toner image to the transfer unit. The third distance may be different from at least one of the first distance and the second distance.

The image transfer apparatus may further include a third pair of a photoconductive drum and a roller which are separated from each other by a third distance to transfer a third toner image to the transfer unit. The photoconductive drum of the first pair may be spaced apart from the photoconductive drum of the second pair by a length, and the photoconductive drum of the second pair may be spaced apart from the photoconductive drum of the third pair by another distance.

The third distance may be different from at least one of the first distance and the second distance, and the length and the another length are same.

The third distance may be the same as at least one of the first distance and the second distance, and the length and the another length may be same.

The first pair may form a first transfer voltage with the transfer unit for a first period, the second pair may form a second transfer voltage with the transfer unit for a second period, the third pair may form a third transfer voltage with the transfer unit for a third period, and at least one of the first, second, third periods may be same as at least the other one of the first, second, and third periods.

The first pair and the second pair may form a first transfer voltage and a second transfer voltage, respectively, which are different from each other according to the first and second distances between the photoconductive drum and the roller of the corresponding pairs.

The first pair and the second pair may be supplied with a same voltage from a voltage source, and the first pair and the second pair may form a first transfer voltage and a second transfer voltage, respectively, which are different from each other according to the first and second distances of the corresponding pairs.

The first pair and the second pair may form different transfer voltages according to a difference between the first and second distances.

The first pair and the second pair may form different resistances according to a difference between the first and second distances.

The first pair may transfer the first image to the transfer unit, the second pair may transfer the second image to the transfer unit over the transferred first image, and the first and second pairs may form different resistances to apply different transfer voltages to transfer the first and second images, respectively, according to a difference between a thickness of the transfer unit and a thickness of the transfer unit and the transferred first image.

According to features and utilities of the present general inventive concept, there is provided an image forming apparatus including a transfer unit to move in a direction, a first pair of a photoconductive drum and a roller which are spaced apart from each other by a first distance to transfer a first toner image to the transfer unit, a second pair of a photoconductor drum and a roller which are spaced apart from each other by a second distance to transfer a second toner image to the transfer unit, an optical scanning unit to form latent images on the photoconductor drums, and a developing unit to supply a developer to the latent images to form the first and second toner images. The first distance may be different from the second distance

BRIEF DESCRIPTION OF THE DRAWINGS

The above and other features and advantages of the present general inventive concept will become more apparent by describing in detail exemplary embodiments thereof with reference to the attached drawings in which.

DETAILED DESCRIPTION OF THE EMBODIMENTS

Figure 1:
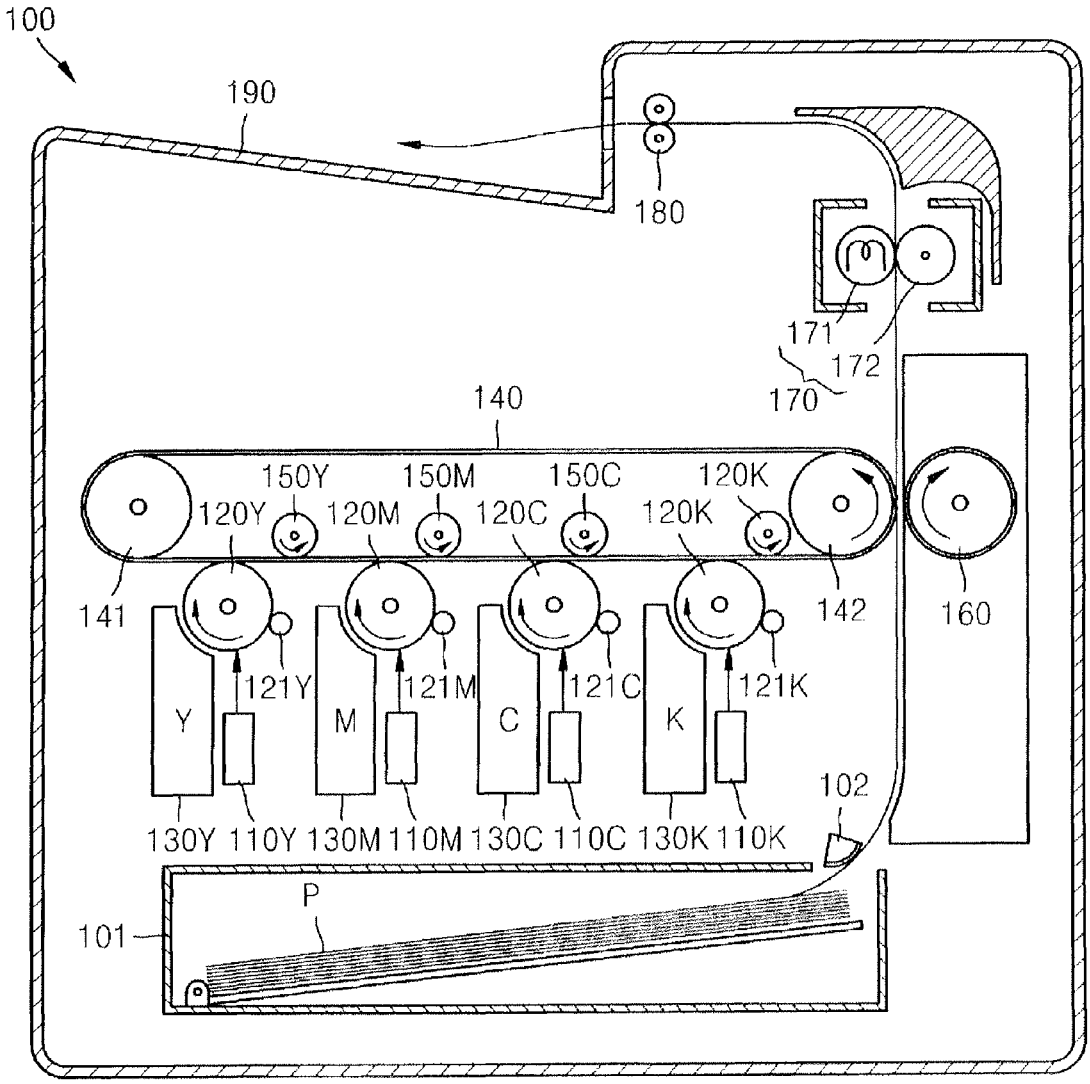
FIG. 1 is a cross-sectional view of a configuration of an image forming apparatus, according to an embodiment of the present general inventive concept.

An image forming apparatus according to the present invention will now be described more fully with reference to the accompanying drawings, in which exemplary embodiments of the present invention are shown. The invention may, however, be embodied in many different forms and should not be construed as being limited to the embodiments set forth herein; rather, these embodiments are provided so that this disclosure will be thorough and complete, and will fully convey the concept of the invention to those skilled in the art. In the drawings, the thickness of layers and regions are exaggerated for clarity. Like reference numerals in the drawings denote like elements, and thus their description will be omitted.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
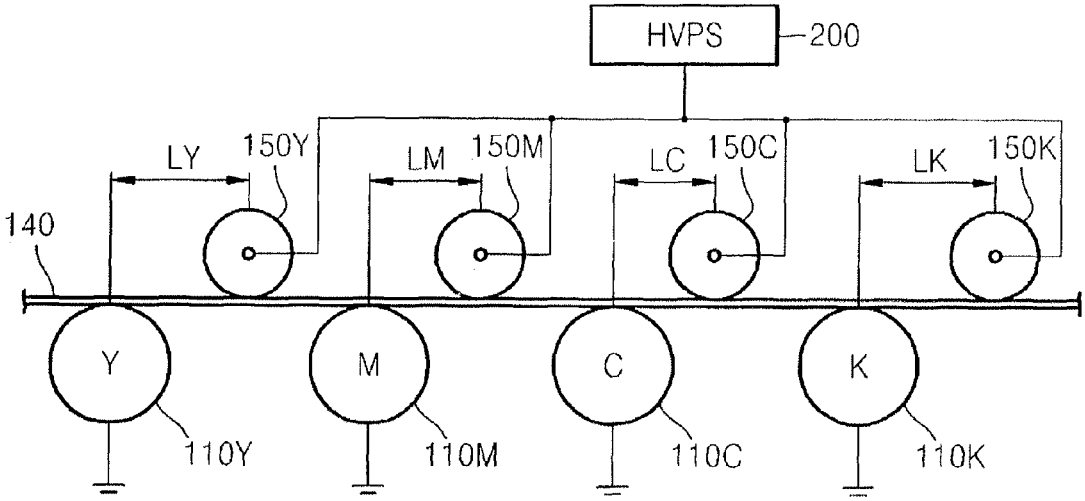
FIG. 2 is a cross-sectional view of an arrangement relationship between four photoconductive drums and four first transfer rollers of FIG. 1, according to an embodiment of the present general inventive concept.
Figure 3:
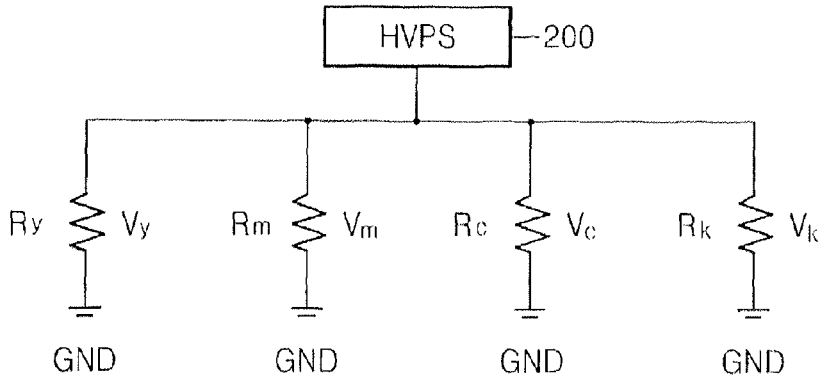
FIG. 3 is a schematic view of fixed voltages corresponding to the photoconductive drums and the first transfer rollers of FIG. 2, according to an embodiment of the present general inventive concept.

FIG. 1 is a cross-sectional view of a configuration of an image forming apparatus 100, according to an embodiment of the present general inventive concept. FIG. 2 is a cross-sectional view of an arrangement relationship between four photoconductive drums 120Y, 120M, 120C, and 120K and four first transfer rollers 150Y, 150M, 150C, and 150K of FIG. 1, according to an embodiment of the present general inventive concept. FIG. 3 is a schematic view of fixed voltages corresponding to the photoconductive drums 120Y, 120M, 120C, and 120K and the first transfer rollers 150Y, 150M, 150C, and 150K of FIG. 2, according to an embodiment of the present general inventive concept.

Referring to FIG. 1, the image forming apparatus 100 of the present embodiment may include four optical scanning units 110Y, 110M, 110C, and 110K, the four photoconductive drums 120Y, 120M, 120C, and 120K, four charging rollers 121Y, 121M, 121C, and 121K, four developing units 130Y, 130M, 130C, and 130K, an intermediate transfer unit 140, the four first transfer rollers 150Y, 150M, 150C, and 150K, a second transfer roller 160, and a fixing unit 170.

The optical scanning units 110Y, 110M, 110C, and 110K scan light modulated according to image information onto the photoconductive drums 120Y, 120M, 120C, and 120K charged by corresponding charging rollers 121Y, 121M, 121C, and 121K to a uniform potential. Laser scanning units (LSU), which deflect light irradiated from a laser diode in a main scanning direction using a polygon mirror and scan the light onto the photoconductive drums 120Y, 120M, 120C, and 120K, may be used as the optical scanning units 110Y, 110M, 110C, and 110K.

The photoconductive drums 120Y, 120M, 120C, and 120K are photoconductors and include photoconductive layers having a predetermined thickness formed on a circumferential surface of a cylindrical metal pipe. The circumferential surfaces of the photoconductive drums 120Y, 120M, 120C, and 120K correspond to scanned surfaces onto which the light scanned by the optical scanning units 110Y, 110M, 110C, and 110K is formed. Photoconductive belts may be used as the photoconductive drums 120Y, 120M, 120C, and 120K.

The charging rollers 121Y, 121M, 121C, and 121K are chargers that contact and rotate the photoconductive drums 120Y, 120M, 120C, and 120K, respectively, and charge surfaces of the photoconductive drums 120Y, 120M, 120C, and 120K to a uniform potential. A charging voltage is applied to the charging rollers 121Y, 121M, 121C, and 121K. Corona chargers may be used as the charging rollers 121Y, 121M, 121C, and 121K.

The developing units 130Y, 130M, 130C, and 130K each contain toner to be moved or supplied to the corresponding photoconductive drums 120Y, 120M, 120C, and 120K according to developing voltages applied between the developing units 130Y, 130M, 130C, and 130K and the photoconductive drums 120Y, 120M, 120C, and 120K, and thereby developing electrostatic latent images into visible toner images.

The toner images of the photoconductive drums 120Y, 120M, 120C, and 120K are transferred onto the intermediate transfer unit 140 and a color image or a mono image is formed thereon. The intermediate transfer unit 140 is supported by rollers 141 and 142 and rotates via contact with the photoconductive drums 120Y, 120M, 120C, and 120K. The intermediate transfer unit 140 may have uniform surface and volume resistances. The intermediate transfer unit 140 may be an intermediate transfer belt 140.

The first transfer rollers 150Y, 150M, 150C, and 150K apply first transfer voltages between the photoconductive drums 120Y, 120M, 120C, and 120K and the intermediate transfer unit 140 to transfer the toner images on the photoconductive drums 120Y, 120M, 120C, and 120K onto the intermediate transfer unit 140. The first transfer rollers 150Y, 150M, 150C, and 150K may be formed of a conductive metal material having a resistance of or close to 0 ohms.

The second transfer roller 160 is supplied with a second transfer voltage in order to transfer the toner images formed on the intermediate transfer unit 140 onto a sheet of paper. The toner images transferred onto the sheet of paper passes through the fixing unit 170, which includes a heating roller 171 and a pressure roller 172, the sheet of paper is heated while pressure is applied thereto to fix the toner images onto the sheet of paper, and the sheet of paper is discharged to a paper discharging unit 190 via a discharging roller 180.

A paper cassette 101 containing a plurality of sheets of papers P is detachably formed below or in a lower portion of the image forming apparatus. Each sheet of paper P may be picked up by a pickup roller 102 disposed on an upper side of the paper cassette 101 and delivered into the image forming apparatus.

In order to print a color image, the image forming apparatus of the present embodiment includes the four optical scanning units 110Y, 110M, 110C, and 110K, the four photoconductive drums 120Y, 120M, 120C, and 120K, the four charging rollers 121Y, 121M, 121C, and 121K, the four developing units 130Y, 130M, 130C, and 130K, and the four first transfer rollers 150Y, 150M, 150C, and 150K. The optical scanning units 110Y, 110M, 110C, and 110K respectively scan light corresponding to image information of yellow Y, magenta M, cyan C, and black K color images onto the four photoconductive drums 120Y, 120M, 120C, and 120K and form four electrostatic latent images. The four developing units 130Y, 130M, 130C, and 130K respectively supply toner of yellow Y, magenta M, cyan C, and black K to the respective four photoconductive drums 120Y, 120M, 120C, and 120K and form yellow Y, magenta M, cyan C, and black K toner images. The four charging rollers 121Y, 121M, 121C, and 121K are supplied with the first transfer voltages so as to transfer yellow Y, magenta M, cyan C, and black K toner images formed on the four photoconductive drums 120Y, 120M, 120C, and 120K onto the intermediate transfer unit 140.

The image forming apparatus of the present embodiment having the above mentioned structure is an indirect transfer type image forming apparatus that uses an intermediate transfer unit, which is advantageous compared to a direct transfer type image forming apparatus that uses a paper transfer belt, as will be described below.

The paper transfer belt of the direct transfer type image forming apparatus needs a relatively high voltage (generally greater than 2000 V) since the direct transfer type image forming apparatus uses an absorption magnetic field to absorb a paper and a transfer magnetic field to transfer a toner image.

Also, the direct transfer type image forming apparatus using the paper transfer belt may have low transfer efficiency with respect to toner coverage (%). In more detail, the strength of a magnetic field to transfer an image is proportional to (toner coverage thereof), for example, a full-solid image uses a relatively great magnetic field. When the same transfer magnetic field is applied to an image on a sheet of paper having lower toner coverage, toner scattering and inverse transfer may occur since the sheet of paper is separated from a transfer nip when the magnetic field is applied, and thus the efficiency of the direct transfer type image forming apparatus may be low. Thus, transfer magnetic fields are optimized according to toner coverage (%), making it difficult to use a general high voltage.

System impedance of a transfer system that uses a paper transfer belt changes greatly according to environment and thus it is difficult to optimize transfer due to the following.

First, a first transfer roller that forms a magnetic field and conveys a paper is formed of foam rubber and resistance thereof changes greatly according to temperature and moisture. If the first transfer roller is ion conductive, resistance thereof may increase 100 times in low temperature and dry environments compared to high temperature and moist environments.

Second, a sheet of paper conveyed on a paper transfer belt has various physical properties and rigidity which can be changed according to environments. In particular, the paper is formed of a fibrous material and thus exhibits strong magnetic field leakage characteristics in high moisture environments. A rigidity greatly increases in low temperature and low moisture environments and thus the sheet of paper is not conveyed through the paper transfer belt, and thus requiring a relatively large paper adsorption magnetic field.

Third, when papers conveyed on a paper transfer belt are introduced into different transfer units, pass therethrough, and are escaped therefrom, an alternate interference of a current flow between systems that is carried by papers seriously occurs.

Fourth, a paper transfer belt and a sheet of paper conveyed along the paper transfer belt sequentially pass through a paper adsorption unit and a plurality of transfer units so that various amounts of static electricity is accumulated on the paper transfer belt and the sheet of paper, requiring a complicated structure of removing static electricity. In this regard, when a device removes an excessive or slight amount of current for removing static electricity, various image defects, such as a water drop, a scratch, spreading, etc., making it difficult to design a transfer system that uses a paper transfer belt.

As described above, an indirect transfer type image forming apparatus that uses an intermediate transfer unit is an alternative to overcome the defects of a direct transfer type image forming apparatus that uses a paper transfer belt.

An indirect transfer is performed according to parameters of an intermediate transfer unit such as a surface resistance ρs and a volume resistance ρv, which are intrinsic properties of the intermediate transfer unit, and a distance L between a photoconductive drum and a first transfer roller. The surface resistance ρs and the volume resistance ρv are constant values since the surface resistance ρs and the volume resistance ρv are intrinsic properties of matter of the intermediate transfer unit and thus they are not easily changed. Therefore, transferring of a toner image may be adjusted by varying the distance L between the photoconductive drum and the first transfer roller.

Referring to FIG. 2, image forming units corresponding to yellow Y, magenta M, cyan C, and black K are sequentially arranged in a direction that the intermediate transfer unit 140 travels. However, arrangement sequence of the image forming units is not limited thereto, and the image forming units corresponding to yellow Y, magenta M, and cyan C may be variously arranged. For example, the image forming units may be sequentially arranged such that the sequence corresponds to yellow Y, magenta M, and then cyan C, corresponds to magenta M, cyan C, and then yellow Y, or corresponds to cyan C, yellow Y, and then magenta M.

Meanwhile, the image forming unit corresponding to black K may be selectively arranged on either side of the image forming units corresponding to yellow Y, magenta M, and cyan C. For example, the image forming units may be sequentially arranged such that the sequence corresponds to black K, yellow Y, magenta M, and then cyan C, corresponds to black K, magenta M, cyan C, and then yellow Y color images, corresponds to black K, cyan C, yellow Y, and then magenta M, corresponds to magenta M, cyan C, yellow Y, and then black K, or corresponds to cyan C, yellow Y, magenta M, and then black K.

The first transfer rollers 150Y, 150M, 150C, and 150K are connected to a single high voltage power supply (HVPS) 200. The four photoconductive drums 120Y, 120M, 120C, and 120K are grounded. The first transfer rollers 150Y, 150M, 150C, and 150K and the four photoconductive drums 120Y, 120M, 120C, and 120K contact the intermediate transfer unit 140, forming a closed circuit.

Distances between the four photoconductive drums 120Y, 120M, 120C, and 120K and the first transfer rollers 150Y, 150M, 150C, and 150K, respectively, are different from each other.

In more detail, a distance LY between the photoconductive drum 120Y and the first transfer roller 150Y, corresponding to yellow Y, a distance LM between the photoconductive drum 120M and the first transfer roller 150M, corresponding to magenta M, and a distance LC between the photoconductive drum 120C and the first transfer roller 150C, corresponding to cyan C, are sequentially reduced. That is, the distances LY, LM, and LC between the photoconductive drums 120Y, 120M, and 120C and the first transfer rollers 150Y, 150M, and 150C, respectively, are reduced downstream in the direction that the intermediate transfer unit 140 travels. A distance LK between the photoconductive drum 120K and the first transfer roller 150K may be equal to or smaller than any of the distances LY, LM, and LC.

Referring to FIG. 3, combinations of the four photoconductive drums 120Y, 120M, 120C, and 120K, the corresponding first transfer rollers 150Y, 150M, 150C, and 150K, and the intermediate transfer unit 140 may be modeled (or formed) as single resistors Ry, Rm, Rc, and Rk during corresponding transferring operations Accordingly, Vy may denote a voltage between ends of a resistor Ry corresponding to a yellow Y color image, Vm may denote a voltage between ends of a resistor Rm corresponding to a magenta M color image, Vc may denote a voltage between ends of a resistor Rc corresponding to a cyan C color image, and Vk may denote a voltage between ends of a resistor Rk corresponding to a black K color image. The above describe voltages Vy, Vm, Vc, and Vk may be substantially constant (or fixed) during the corresponding transferring operation. Toner images of different colors of the four photoconductive drums 120Y, 120M, 120C, and 120K are transferred onto the intermediate transfer unit 140 according to the voltages Vy, Vm, Vc, and Vk, respectively.

In this regard, the voltages Vy, Vm, Vc, and Vk corresponding to yellow Y, magenta M, cyan C, and black K, respectively, may change according to the distances LY, LM, LC, and LK between the four photoconductive drums 120Y, 120M, 120C, and 120K, and the first transfer rollers 150Y, 150M, 150C, and 150K, respectively. In more detail, the greater the distances LY, LM, LC, and LK, the lower the fixed voltages Vy, Vm, Vc, and Vk, and the less the distances LY, LM, LC, and LK, the greater the fixed voltages Vy, Vm, Vc, and Vk. Thus, the fixed voltages Vy, Vm, Vc, and Vk used to transfer toners of the four photoconductive drums 120Y, 120M, 120C, and 120K onto the intermediate transfer unit 140 may change according to the distances LY, LM, LC, and LK between the four photoconductive drums 120Y, 120M, 120C, and 120K, and the first transfer rollers 150Y, 150M, 150C, and 150K, respectively.

As described above, the distances LY, LM, and LC are reduced downstream in the direction that the intermediate transfer unit 140 travels, whereas the distance LK is different for the following reasons. That is, the distances LY, LM, and LC are decreased according to a distance from a location of the photoconductive drum 120Y.

Yellow Y, magenta M, and cyan C color images overlap each other downstream in the direction that the intermediate transfer unit 140 travels to form color images and thus it is necessary to sequentially increase the fixed voltages Vy, Vm, and Vc. However, black K color image does not overlap with other colors and forms a mono image and thus it is unnecessary to sequentially increase the fixed voltage Vk with respect to the yellow Y, magenta M, and cyan C color images. The first transfer voltage Vk may be equal to or lower than any of the fixed voltages Vy, Vm, and Vc for transferring the yellow Y, magenta M, and cyan C color images.

An operation of overlapping the yellow Y, magenta M, and cyan C colors according to the present embodiment will now be described with reference to FIGS. 2 through 6. An operation of transferring black K color images is the same as the operation of transferring each of the yellow Y, magenta M, and cyan C color images and thus detailed description thereof will not be repeated hereinafter.

Figure 4:
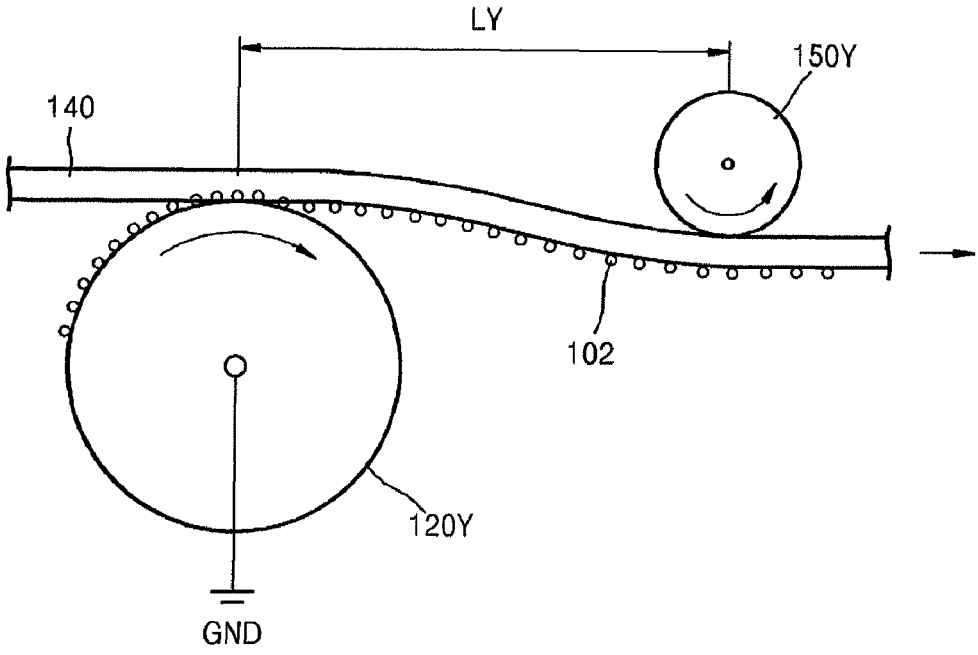
FIG. 4 is a schematic cross-sectional view for explaining an operation of transferring a yellow color image according to an embodiment of the present general inventive concept.
Figure 5:
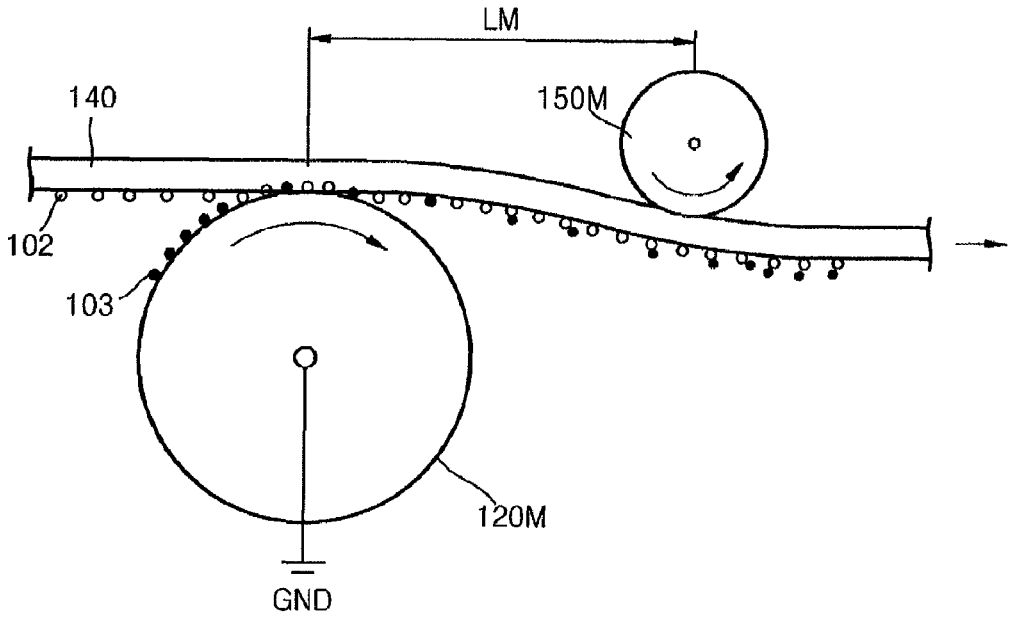
FIG. 5 is a schematic cross-sectional view for explaining an operation of transferring a magenta color image according to an embodiment of the present general inventive concept.
Figure 6:
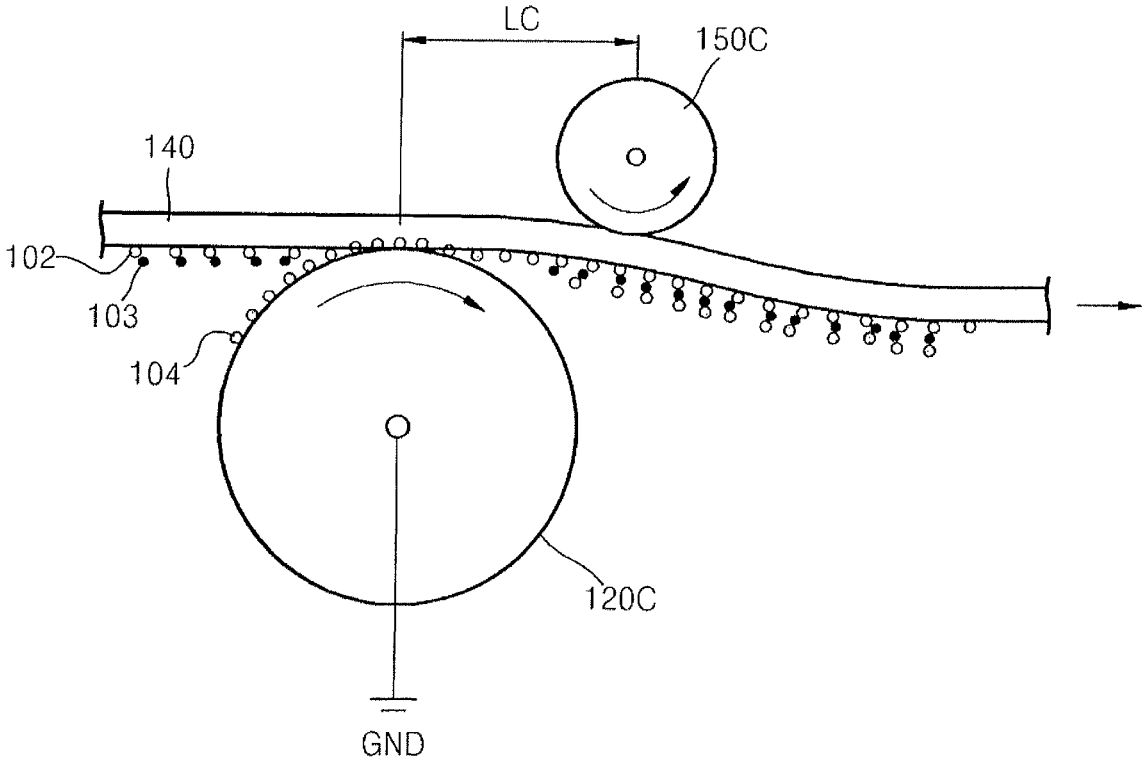
FIG. 6 is a schematic cross-sectional view for explaining an operation of transferring a cyan color image according to an embodiment of the present general inventive concept.

FIG. 4 is a schematic cross-sectional view for explaining an operation of transferring a yellow color according to an embodiment of the present general inventive concept. FIG. 5 is a schematic cross-sectional view for explaining an operation of transferring a magenta color and overlapping the magenta color on the yellow color according to an embodiment of the present general inventive concept. FIG. 6 is a schematic cross-sectional view for explaining an operation of transferring a cyan color and overlapping the cyan color on the magenta color according to an embodiment of the present general inventive concept.

Referring to FIGS. 2 through 4, the first transfer roller 150Y is spaced apart from the photoconductive drum 120Y by the distance LY. The first transfer voltage Vy, which is a portion of the fixed voltage applied from the single HVPS 200, is generated according to the distance LY and is applied to the first transfer roller 150Y. In this regard, a yellow toner image 102 attached to the surface of the photoconductive drum 120Y is transferred to the intermediate transfer unit 140 according to the first transfer voltage Vy.

Referring to FIGS. 2, 3 and 5, the first transfer roller 150M is spaced apart from the photoconductive drum 120M by the distance LM. The distance LM is smaller than the distance LY between the first transfer roller 150Y and the photoconductive drum 120Y. The first transfer voltage Vm, which is a portion of the fixed voltage applied from the single HVPS 200, is generated according to the distance LM and is applied to the first transfer roller 150M. In this regard, a magenta toner image 103 attached to the surface of the photoconductive drum 120M is transferred to the intermediate transfer unit 140 according to the first transfer voltage Vm and overlaps the yellow toner image 102.

Referring to FIGS. 2, 3 and 6, the first transfer roller 150C is spaced apart from the photoconductive drum 120C by the distance LC. The distance LC is smaller than the distance LM between the first transfer roller 150M and the photoconductive drum 120M. The first transfer voltage Vc, which is a portion of the fixed voltage applied from the single HVPS 200, is generated according to the distance LC and is applied to the first transfer roller 150C. In this regard, a cyan toner image 104 attached to the surface of the photoconductive drum 120C is transferred to the intermediate transfer unit 140 according to the first transfer voltage Vc and overlaps the yellow toner image 102 and the magenta toner image 103.

Figure 7:
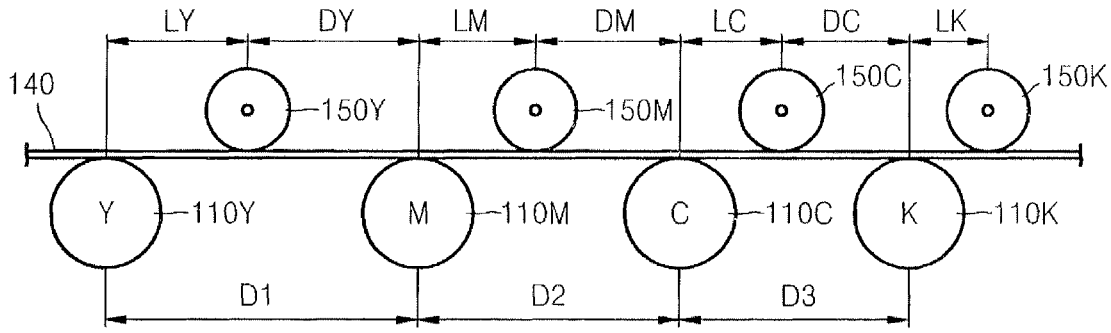
FIG. 7 is a view illustrating an arrangement of photoconductive drums and first transfer rollers in an image forming apparatus according to an embodiment of the present general inventive concept.

FIG. 7 is a view illustrating an arrangement of photoconductive drums and first transfer rollers in an image forming apparatus according to an embodiment of the present general inventive concept. Referring to FIG. 7, the roller 150Y is spaced apart from the photoconductive drum 120M by a distance DY in a moving direction of the intermediate transfer unit 140, the roller 150M is spaced apart from the photoconductive drum 120C by a distance DM in a moving direction of the intermediate transfer unit 140, and the roller 150C is spaced apart from the photoconductive drum 120K by a distance DC in a moving direction of the intermediate transfer unit 140.

Here, the distances DY, DM, and DC may be different from each other. It is possible that the distance DY is longer than the distances DM and DC. It is also possible that the distance DC is shorter than the distances DY and DM. However, the present general inventive concept is not limited thereto. It is also possible that the distances DY, DM, and DC may be same.

The roller 150Y may be disposed on a position to form the voltage VY with the photoconductive drum 110Y and also not to interrupt the voltage VM to be formed between the roller 150M and the photoconductive drum 110M. The roller 150M may be disposed on a position to form the voltage VM with the photoconductive drum 110M and also not to interrupt the voltage VC to be formed between the roller 150C and the photoconductive drum 110C. The roller 150C may be disposed on a position to form the voltage VC with the photoconductive drum 110C and also not to interrupt the voltage VK to be formed between the roller 150K and the photoconductive drum 110K.

The photoconductive drum 110Y is spaced apart from the photoconductive drum 110M by a distance (length) D1 in a moving direction of the intermediate transfer unit 140, the photoconductive drum 110M is spaced apart from the photoconductive drum 110C by a distance (length) D2 in a moving direction of the intermediate transfer unit 140, and the photoconductive drum 110C is spaced apart from the photoconductive drum 110K by a distance (length) D3 in a moving direction of the intermediate transfer unit 140. Here, the distances (lengths) D1, D2, and D3 may be same. However, the present general inventive concept is not limited thereto. It is possible that the distances D1, D2, and D3 may be different from each other. It is possible that the distance D3 may be different from at least one of the distances D1 and D2.

While the present general inventive concept has been particularly shown and described with reference to exemplary embodiments thereof, it will be understood by those of ordinary skill in the art that various changes in form and details may be made therein without departing from the spirit and scope of the present general inventive concept as defined by the following claims.

What is claimed is:

1. An image forming apparatus comprising:

a plurality of optical scanning units to scan light modulated according to an image signal;

a plurality of photoconductive drums to have thereon a plurality of electrostatic latent images formed by the light scanned from the plurality of optical scanning units;

a plurality of developing units to develop the plurality of electrostatic latent images formed on the plurality of photoconductive drums into a plurality of toner images;

an intermediate transfer unit to transfer the plurality of toner images developed by the plurality of developing units;

a plurality of first transfer rollers installed in the intermediate transfer unit to correspond to the plurality of photoconductive drums, respectively, and to apply transfer voltages to transfer the plurality of toner images onto the intermediate transfer unit;

a second transfer roller to transfer the plurality of toner images formed on the intermediate transfer unit onto a sheet of paper; and a fixing unit to fix the plurality of toner images transferred onto the paper, wherein the plurality of first transfer rollers comprises first transfer rollers of a first group in which distances between the first transfer rollers of the first group and the plurality of photoconductive drums, respectively, are sequentially reduced downstream along a direction that the intermediate transfer unit travels, and a position of a first transfer roller of a second group is independent of the sequential reduction of the distances between the first transfer rollers of the first group and the plurality of photoconductive drums.

2. The image forming apparatus of claim 1, wherein each of the first transfer rollers of the first group correspond to yellow, magenta, and cyan images, respectively, and are optionally arranged along the direction that the intermediate transfer unit travels.

3. The image forming apparatus of claim 1, wherein each of the first transfer rollers of the first group are arranged to correspond to yellow, magenta, and cyan images, respectively.

4. The image forming apparatus of claim 1, wherein the first transfer roller of the second group corresponds to black.

5. The image forming apparatus of claim 4, wherein a distance between the first transfer roller of the second group and the photoconductive drum corresponding to the first transfer roller of the second group is equal to the distance between any one of the first transfer rollers of the first group and the photoconductive drum corresponding to the any one of the first transfer rollers of the first group.

6. The image forming apparatus of claim 4, wherein the distance between the first transfer roller of the second group and the photoconductive drum corresponding to the first transfer roller of the second group is less than the distance between any one of the first transfer rollers of the first group and the photoconductive drum corresponding to the any one of the first transfer rollers of the first group.

7. The image forming apparatus of claim 1, further comprising:

a single high voltage power supply (HVPS) connected to each of the plurality of first transfer rollers and applying a transfer voltage to the plurality of first transfer rollers.

8. An image transfer apparatus usable with an image forming apparatus to form an image, comprising:

a transfer unit to move in a direction;

a first pair of a first photoconductive drum and a first roller which are spaced apart from each other by a first distance to transfer a first toner image to the transfer unit;

a second pair of a second photoconductor drum and a second roller which are spaced apart from each other by a second distance to transfer a second toner image to the transfer unit;

another pair of a photoconductive drum and a roller which are separated from each other by another distance to transfer another toner image to the transfer unit; and a third pair of a photoconductive drum and a roller which are separated from each other by a third distance to transfer a third toner image to the transfer unit, wherein the first distance is different from the second distance, wherein the another distance is same as at least one of the first distance and the second distance, and wherein the third distance is different from each of the first distance and the second distance.

9. The image transfer apparatus of claim 8, wherein the first pair and the second pair form a first transfer voltage and a second transfer voltage, respectively, which are different from each other according to the first and second distances between the photoconductive drum and the roller of the corresponding pairs.

10. The image transfer apparatus of claim 8, wherein the first pair and the second pair are supplied with a same voltage from a voltage source, and the first pair and the second pair form a first transfer voltage and a second transfer voltage, respectively, which are different from each other according to the first and second distances of the corresponding pairs.

11. The image transfer apparatus of claim 8, wherein the first pair and the second pair form different transfer voltages according to a difference between the first and second distances.

* * * * *